United States Patent [19]

Smith

[11] 3,961,549

[45] June 8, 1976

[54] DIE CHANGING TURRET TABLE SEGMENT

[75] Inventor: Franklin A. Smith, Clarence, N.Y.

[73] Assignee: Houdaille Industries, Inc., Buffalo, N.Y.

[22] Filed: June 16, 1975

[21] Appl. No.: 587,392

[52] U.S. Cl. ..... 83/552; 83/648; 83/859

[51] Int. Cl.[2] ..... B26D 7/00

[58] Field of Search ..... 83/552, 648, 859

[56] References Cited

UNITED STATES PATENTS 3,717,061 2/1973 Daniels ..... 83/552 X

*Primary Examiner*—J. M. Meister

*Attorney, Agent, or Firm*—Hill, Gross, Simpson, Van Santen, Steadman, Chiara & Simpson

[57] ABSTRACT

A turret worktable for a turret punch machine tool with the table aligned adjacent to the top of the die turret, the dies extending below the table top. The top has a section thereof extending from an edge of the table to the edge of the lower die turret, which is pivotable through an arc from an operating position adjacent to the die turret and plainer with the remainder of the table to a die removal position located below and to the side of the dies in the lower die turret. The segment forms a worktable top when in the die changing position.

11 Claims, 13 Drawing Figures

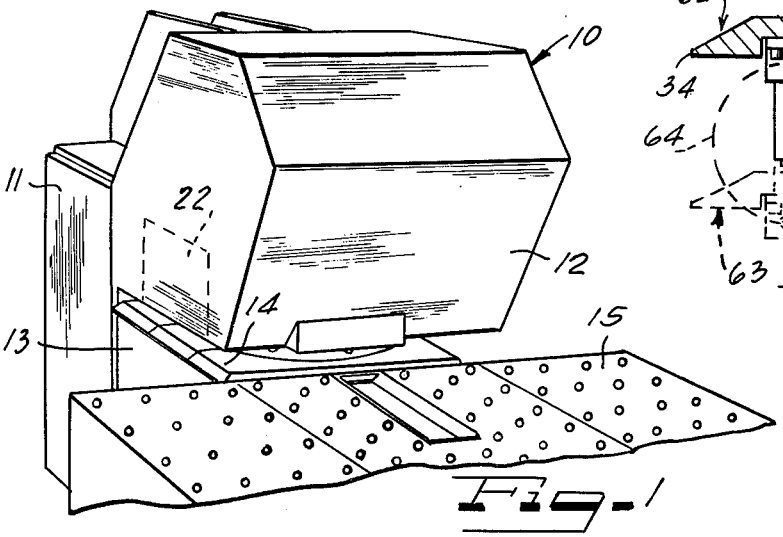
Fig. 1
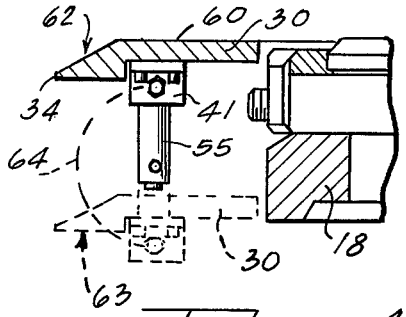
Fig. 4
Fig. 2
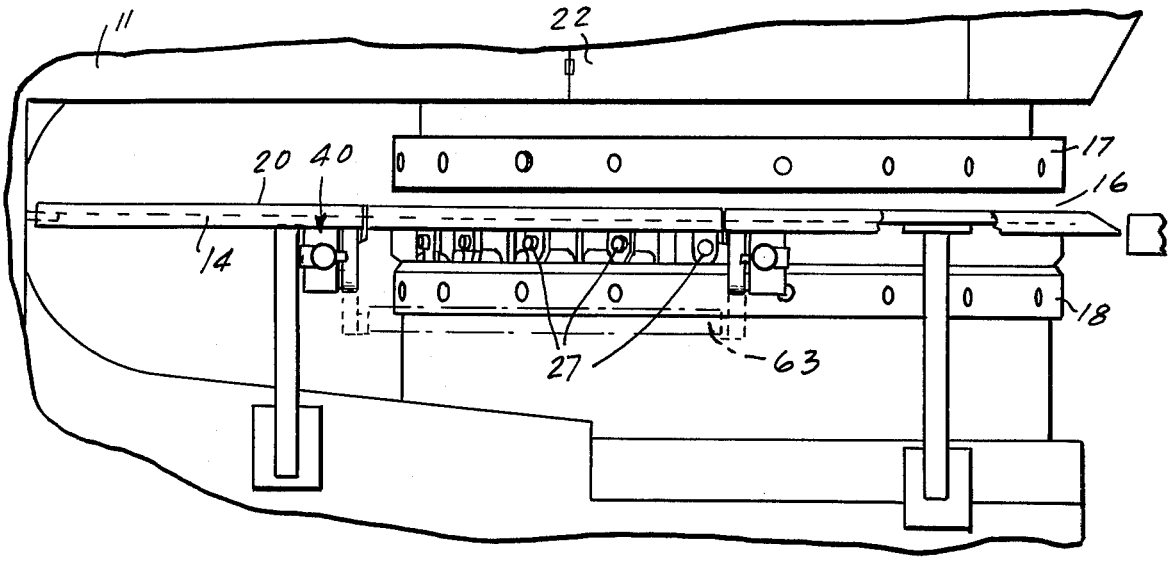
Fig. 3
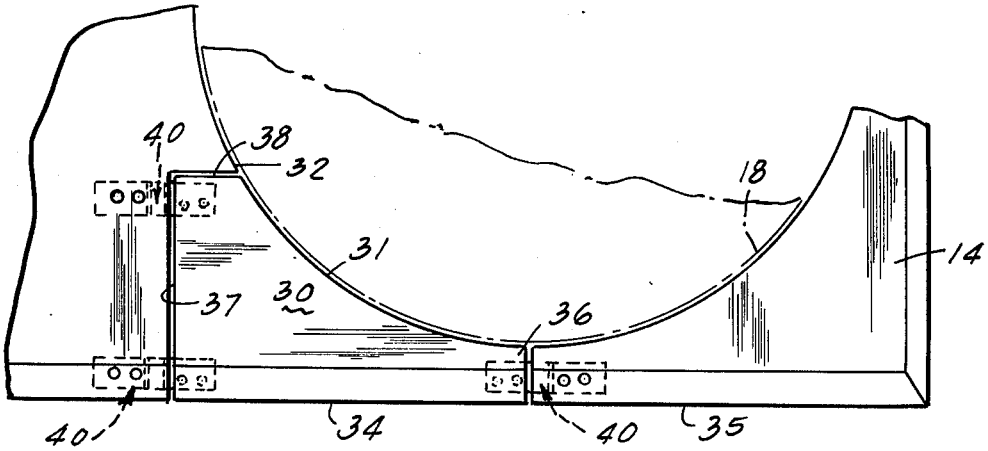

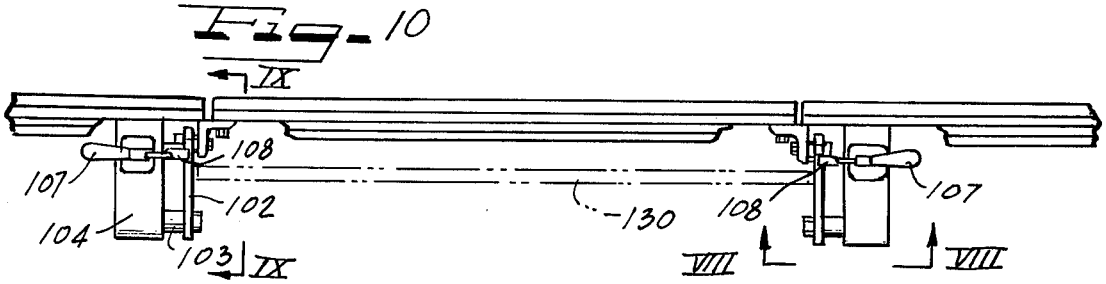
Fig. 10
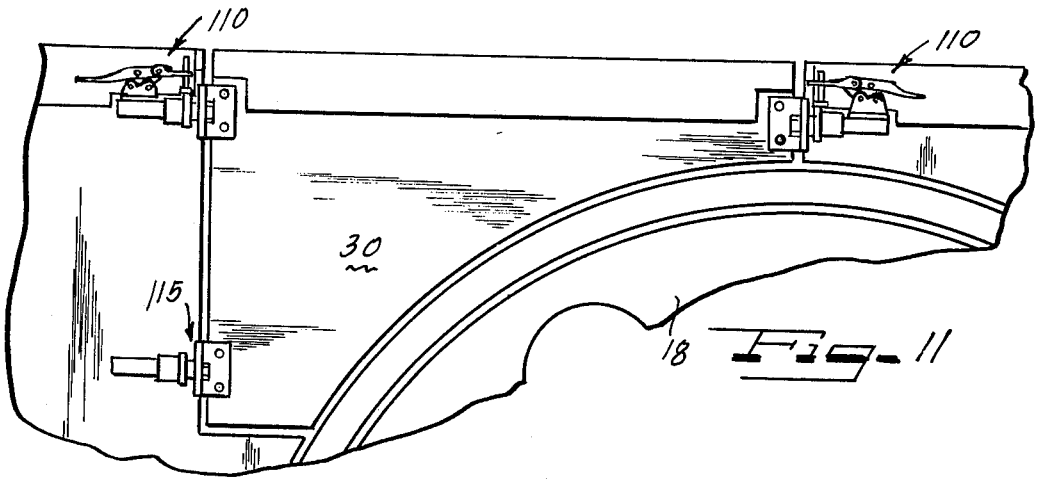
Fig. 11
Fig. 12
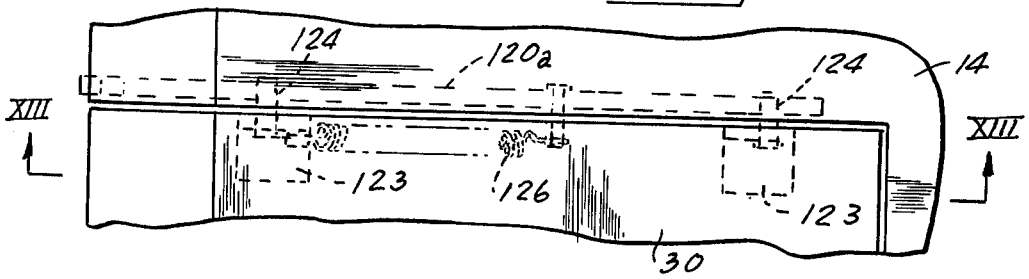
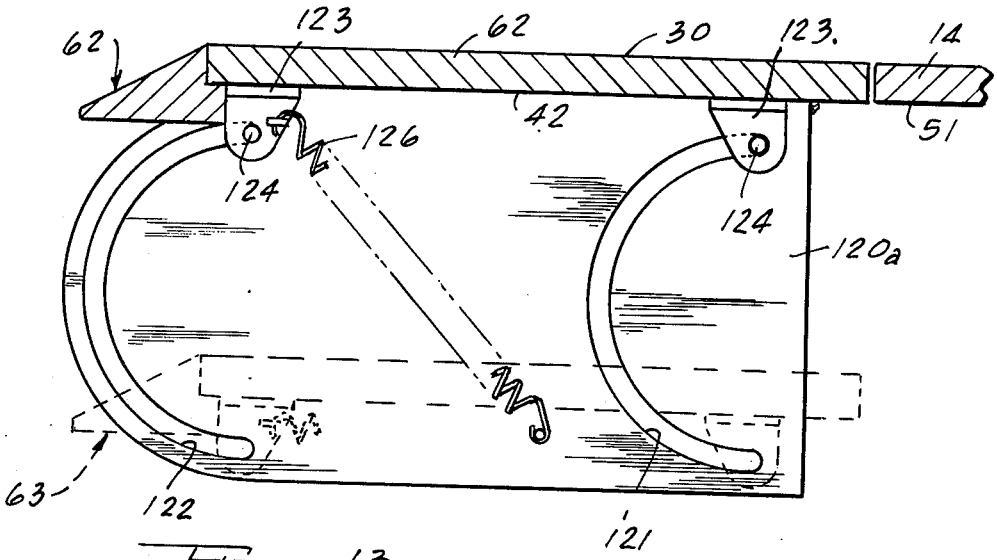
Fig. 13

DIE CHANGING TURRET TABLE SEGMENT

BACKGROUND OF THE INVENTION

1. Field of the Invention

This invention relates to machine tools and more particularly to turret punched machine tools.

2. Prior Art

Machine tools such as turret punches having upper and lower revolving turrets are well known to the art. Such devices usually include a machine frame which is C shaped with a upper turret depending from the top of the C at the opening of the C and the lower turret aligned with the upper turret extending from the bottom of the C at the opening, the upper and lower turrets having a working clearance there between.

Normally, such machines have a plurality of punches carried by the rotatable upper turret and a plurality of dies carried by the lower turret. Indexing of the two turrets will bring any one of a number of corresponding dies and punches into an operating position, normally at the front of the opening. Thereafter a workpiece is inserted between the turrets at the operating position and the machine is activated to force the punch through the workpiece into the die.

In order to support the workpiece, a table member surrounds the lower turret and has a table top on a level with a top of the lower die turret. The workpiece is then moved into the area between the upper and lower turrets and is partially supported on the worktable.

Since the table top extends outwardly beyond the turret, it is extremely difficult to change the dies. The upper turret is normally surrounded by a shroud which is removable or which can be opened. However due to the necessity of making the worktable sufficiently rigid to support the workpiece, removal of the worktable is quite difficult. While segmenting the table would allow a segment to be removed, this would, in many embodiments, require a two man job, to carry away the heavy table segment to give access to the lower turret dies and would complicate the die changing process.

In many such machines the die is removed from the periphery of the lower turret by removing fastening means at the periphery of the lower turret and thereafter withdrawing the die. This may require a radial clearance of a number of inches in order to lift the die away from the turret.

In addition, dies are normally removed in association with a punch and it would therefore be convenient if both the dies and the punches could be removed at a common peripheral section of the turrets.

Further, dies and punches are often removed in multiples and it would therefore be an advantage to provide a temporary work surface for use by the person removing the tools to store parts thereof at a spot convenient to his reach when working on the turrets.

SUMMARY OF THE INVENTION

My invention provides a die removal feature for turret punch machines which has numerous advantage over the prior art. I provide a segment of the worktable at the periphery of the lower turret which is removable. Further, the segment is hinged to the remainder of the machine so that it pivots outwardly and downwardly from its worktable position to its die removal position where it remains horizontal. The linkage which accommodates the pivot is sufficiently long to allow the table segment, when in its dropped position, to provide more than adequate clearance and access to the periphery of the lower turret. Lock mechanisms maintain the table segment in its normal or raised position to provide an uninterrupted surface for the workpiece being acted upon by the punch.

Although I have described my invention in connection with a turret punch press, it must be understood that my invention could be advantageously used in connection with other devices, including other machine tools utilizing a turret construction which require a work surface at tool height.

It is therefore an object of this invention to provide a turret machine tool having a work surface at approximate tool height with a portion of the work surface hingeably connected to the machine tool and selectively positionable at either a normal worktable height or at a tool changing position spaced from the worktable height but parallel thereto, the segment forming a tool changing work surface when at the tool changing position.

It is another and more particular object of this invention to provide a turret punch with a worktable at a die height adjacent a lower turret and with a segment of the worktable being selectively positionable either at normal table height or at a die changing height below the worktable height, the segment having a surface parallel to the work surface table when at the die changing position.

It is another important object of this invention to provide a turret punch machine having a lower die turret, a worktable surrounding said turret at approximately die height, the worktable having a segment thereof including a peripheral portion immediately adjacent the turret which is hingeably connected to the machine for positioning either at worktable height or at die changing height, the die changing height being below the worktable height by a distance sufficient to give easy access to the dies in the lower turret, the table segment being maintained in a top surface horizontal position at either the worktable height or the die changing height.

Other objects features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 1 is a fragmentary perspective view of a turret punch machine.

FIG. 2 is a fragmentary side plan view of the machine of FIG. 1 illustrating the upper and lower die areas and the worktable.

FIG. 3 is a fragmentary top plan view of the worktable of the machine of FIGS. 1 and 2.

FIG. 4 is a partially sectional fragmentary side view taken along the lines IV—IV of FIG. 3.

FIG. 10 is a fragmentary view of a modified latch system for the table segment of the worktable.

FIG. 11 is a fragmentary bottom plan view of the assembly of FIG. 10.

FIG. 12 is a fragmentary top plan view of another modified latching mechanism for a table segment for the machine tool of FIG. 1.

FIG. 13 is a fragmentary side plan view taken along the lines XIII—XIII of FIG. 12.

DESCRIPTION OF THE PREFERRED EMBODIMENTS

Figure 5:
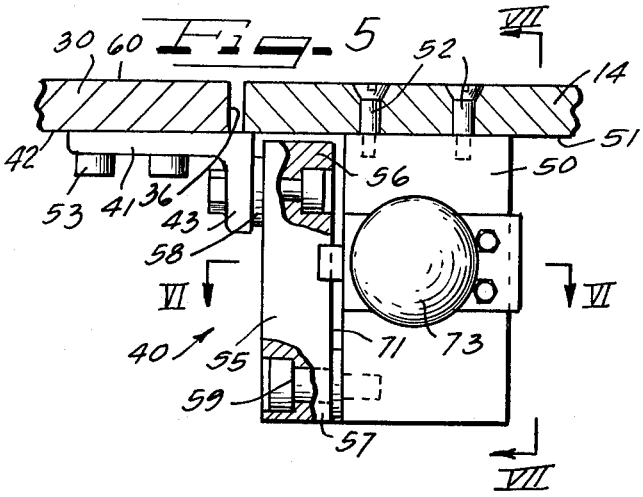
FIG. 5 is a fragmentary partially sectional view of the hingeable connection and latch assembly of the table segment of FIG. 3.

FIG. 1 illustrates a turret punch machine tool 10 which includes a main frame 11, an upper turret and ram assembly 12, a lower turret assembly 13, a worktable 14, and an additional worktable 15, which may be equipped with automatic devices for moving a workpiece.

As best illustrated in FIG. 2 the frame 11 is C shaped in cross section with a workpiece receiving opening 16 between the upper turret 17 and the lower turret 18, the opening in the C shape tool being closed at a back wall 19 which is a part of the frame 11. A worktable 14 projects into the opening of the C and has an upper surface 20 approximately level with the top of the lower turret 18. The upper turret 17 normally carries punches and the lower turret 18 normally carries dies. Access to the punches of the upper turret is normally provided by means of an access door of the like 22. Access to the lower turret dies is from the periphery of the turret and is complicated by reason of the existence of the worktable 14. However, the worktable 14 is necessary to support the workpiece being acted upon by the machine.

FIG. 3 illustrates a top plan view of a portion of the worktable 14 surrounding the lower turret 18. My invention provides for a segment 30 of the worktable which is formed as a separate piece from the remainder of the worktable and includes a inner arcuate wall 31 at the periphery 32 of the lower turret. The segment extends out to an outer side wall 34 at the side 35 of the worktable 14. I have chosen to provide the segment with a narrow end wall 36 lying on a radius of the turret normal to the side wall 35. A wide end wall 37 parallel with the end 36 lies on a plane beyond the periphery of the turret and a short inner side 38 parallel with the outer side 34 extends from the end side 37 to the arcuate side 31. The table segment 30 is attached to the remainder of the worktable 14 by means of a plurality of latching and support devices 40, three of which are illustrated in the view embodiment.

Two of the latching devices 40 lie adjacent the outer edge 34 at the end side walls 36 and 37 and one lies adjacent the inner wall 38 adjacent the wall 37.

As best illustrated in FIG. 5, the latch devices 40 include a bracket number 41 attached to the underside 42 of the table segment 30, the bracket number having a portion 43 extending beyond the associating edge 36 or 37 of the segment. A second bracket member 50 is attached to the undersurface 51 of the table 14 adjacent the edge of the segment and may be fastened by such means as screws 52 or the like, the bracket 41 being attached by similar fastening means 53. The bracket 50 extends below the bracket portion 43 and a link 55 has an upper end 56 pivotably attached to the bracket 43 by pivotable connecting member 58. The lower end 57 of the link 55 is pivotably attached to the bracket 50 by a pivotable connection 59. Due to the use of three such latching and support devices 40 the table segment 30 is pivotable from a normal position with the top 60 of the table segment lying on a plane with the top 20 of the worktable to a die removing position with the top 60 parallel with the top 20 but located below it to a distance equal to twice the distance between the pivotable connections 58 and 59.

This is illustrated in FIG. 4 where the normal position is illustrated at 62 and the die removing position is illustrated at 63, the arc of the top pivot 58 being identified at 64. In this manner, the table segment swings outwardly and downwardly away from the turret 18 when in the bottom position 63, illustrated by broken lines in FIG. 2, provides clear access to the periphery of the lower turret.

Additionally the top surface 60 of the table segment will provide a workbench at the periphery of the turret when in the die removing position 63. This is an added feature in that it allows the operator to assemble pieces immediately in front of him at the area in which he is working on the turret.

Figure 6:
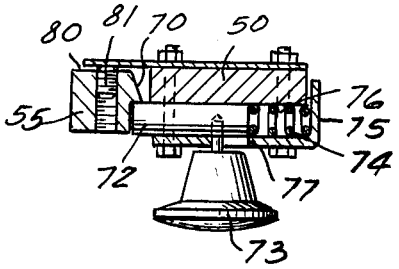
FIG. 6 is a sectional view taken along the lines VI—VI of FIG. 5.
Figure 7:
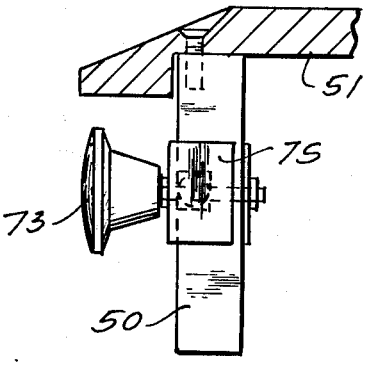
FIG. 7 is a sectional view taken along the lines VII—VII of FIG. 5.

FIGS. 5, 6, and 7 illustrate a latch mechanism for maintaining the segment in its normal position 62. The latch includes a catch 70 on the side 71 of the link 55 facing the bracket 50, and a slidable pen 72 carried by the bracket 50 attached to a control knob 73. The pen 72 is slidable towards and away from the catch and may be spring backed as at 74 with a cover plate 75 closing a groove 76 in the bracket 50, the groove receiving the pen and spring with an opening 77 through the cover plate 75 providing entry for the connection between the control knob 73 in the pen. It is to be noted that I have illustrated a cammed catch 70 allowing automatic snap closure of the table segment in its full raised position.

A backing plate 78 is also attached to the bracket 50 and extends beyond the end of the bracket where it will underlie a portion of the link 55. In this manner, when the back wall 80 of the link contacts the plate 78, further movement of the table will be stopped and it will be in its full raised position. A set screw 81 may also be provided through the link to allow adjustment of contact with the plate 78 so that when the link is in its full raised position, it will be trapped between the catch 70 and the pen 72 and the plate 78, and set screw 81.

FIGS. 8 through 11 illustrate a modified form of the pivotable latching and support device.

Figure 8:
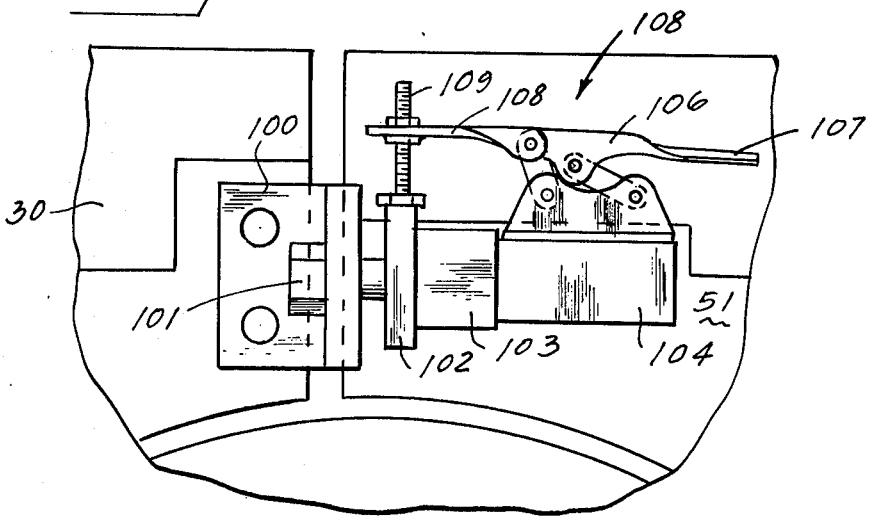
FIG. 8 is a bottom plan view of a modified latch assembly taken along lines VIII—VIII of FIG. 10.

As illustrated in FIG. 8, a bracket 100 is attached to the undersurface of the table segment 30 and has a pivotable connection 101 to a link 102. The link in turn has a pivotable connection 103 to bracket 104 mounted on the undersurface 51 of the worktable adjacent the table segment. This link connection is substantially the same as in the previous embodiment. An over-center latch 106 is also attached to the undersurface 51 and includes an actuating portion 107 and an abutting portion 108 which may be equipped with an adjustable screw stop 109 for abutting the link 102 in its full raised position. Actuation of the portion 107 as illustrated in FIG. 8 will cause the screw stop 109 to raise uperwardly and away from contact with the link. Due to the over-center nature of the latch 110 illustrated in FIGS. 8 through 11, the latch is fully locked when table is in the normal raised position 62 illustrated in FIG. 9.

Although three such connecting links are always provided, this is to be understood that only two latches need be provided adjacent both the end 37 and 36 at the front edge 34 as illustrated in FIG. 11 with the third pivotable connection being free.

FIGS. 12 and 13 illustrated yet another embodiment of the connection between the table segment 30 and the worktable main portion 14. In this embodiment bracket member 120 are suspended from the undersurface 51 of the worktable 14 adjacent to the edges 36 and 37 of the table segment 30. The bracket 120 A adjacent the table segment edge 37 has two arcuate cam grooves 121 and 122 therein. Brackets 123 are attached to the undersurface of 42 of the table segment 30 and carry cam rollers 124 which ride in the cam grooves 121. In this manner the table segment can be moved upwardly and downwardly between a normal working position 62 wherein the top surface of the table segment 30 is even with the top surface of the worktable 14 and a die changing position 63 in which the top surface of the table segment 30 below the top surface fo the worktable 14 but parallel thereto. A over centered spring 126 will function to hold the table in either raised or lowered position and may eliminate the need for a latch if desired. It will be understood that the bracket 120 which is adjacent the edge 36 may have only one such arcuate cam groove therein.

Figure 9:
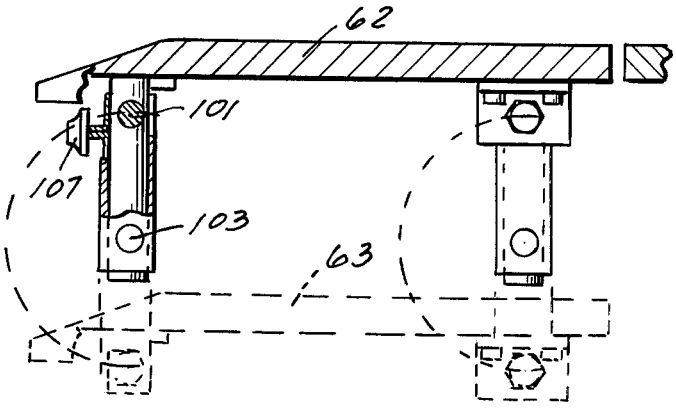
FIG. 9 is a sectional view of the modified latch assembly of FIG. 10 taken along lines IX—IX.

In the embodiments illustrated in FIGS. 4 and 9, in order to insure that the table segment will move between the normal operating position 62 and the die changing position 63 with the top surface maintained parallel to the top surface of the worktable 14, a torsion link 13 illustrated in FIG. 10 may extend between the links 102 of the front edge 34 latching assembly 40.

It can therefore be seen from the above, my invention provides an improved worktable for an opposed turret punch machine with a segment of the worktable extending from a peripheral portion of the lower turret to the edge of the worktable being hingeably connected to the remainder of the machine whereby the segment can be positioned either in a normal position with its top planer with the top of the remainder of the worktable or in a lower turret access position with its top positioned below the top of the worktable by a distance sufficient to give access to the periphery of the lower turret. In the later position, the top of the segment is maintained parallel with the top of the remainder of the worktable and provides a workbench surface for an operator working on the lower turret. Various embodiments showing linkage and latch assemblies for allowing movement of the segment between the two positions and retaining the segment in operating position are also illustrated.

Although the teachings of my invention have herein been discussed with reference to specific theories and embodiments, it is to be understood that these are by way of illustration only and that others may wish to utilize my invention in different designs or applications.

I claim as my invention:

1. In a machine tool having an annular turret with a periphery substantially closed by a worktable having outer edges spaced from the periphery of the turret, the worktable having a segment thereof extending from the periphery of the turret to the outer edge of the worktable removable from the remainder of the worktable to provide access to the periphery of the turret below a common worktable top level, the improvement of said segment being connected to said matching through a plurality of connection means, said segment movable between first and second position, said first position being a work position with a top of the segment planer with the top of the remainder of the worktable, said second position being a turret access position with said top of said segment being spaced below the remainder of said worktable, the said connection means limiting movement of the said segment except between said positions.

2. The improvement of claim 1 wherein the connecting means limits movement of the segment between the first and second positions to movement through an arc upwardly and downwardly from the first position to the second position, the second position lying substantially vertically below the first position, the connecting means effective to maintain parallelism of the top of the segment with the top of the remainder of the worktable.

3. The improvement of the claim number 2 wherein the table segment has a curved edge portion conforming to the curvature of an arcuate lower turret, the segment in its first position having the curved edge portion positioned adjacent to the periphery of the turret and the segment in its second position having the curved edge portion closely adjacent a lower peripheral portion of the turret.

4. The improvement of claim number 2 wherein selectively actuateable latching means are provided to maintain the segment in its first position.

5. The improvement of claim number 4 wherein the connecting means includes elongated link members each of which has one end portion pivotally connected to the segment and another end portion pivotally connected to a machine carried member.

6. The improvement of claim 5 wherein the machine carried member comprises a bracket member fixed to the remaining portion of the worktable.

7. The improvement of claim number 6 wherein the bracket member attached to the remainder of the worktable has the latch means attached to thereto, the latch means having portions thereof engagable with the link to restrict movement of the link.

8. The improvement of claim 2 wherein the connecting means includes cam members carried by said segment indexing with cam tracks carried by said machine.

9. The improvement of claim 8 wherein the cam tracks are formed in bracket members suspended from the underside of the remainder of the worktable adjacent edges of the segment, the cam members carried by the segment being affixed to bracket members suspended from the undersurface of the segment.

10. A machine tool having upper and lower spaced apart turrets, the lower turret having an arcuate periphery with a top and a bottom, the lower turret carrying a plurality of tools, a worktable substantially encompassing the lower turret extending outwardly from the periphery thereof, the worktable having a normal working height top positioned adjacent the top of the lower turret, a segment of the worktable being separated from the remainder thereof, connecting means connecting the segment to the remainder and allowing movement of the segment from a working height position with a top of the segment planer with a top of the remainder to a turret access position with the top of the segment below the top of the remainder by a distance sufficient to allow tools carried by the lower turret to be removed from the turret periphery without contacting the segment, the connecting means maintaining the top of the segment parallel with the top of the remainder of the worktable in both the working height and turret access positions.

11. The machine of claim number 10 wherein the table segment has an inner peripheral portion closely spaced to the periphery of the lower turret in the worktable position and in the turret access position, the segment providing a workbench in the turret access position.

* * * * *